US008154501B2

(12) United States Patent
Yokota

(10) Patent No.: US 8,154,501 B2
(45) Date of Patent: Apr. 10, 2012

(54) DATA LINE DRIVE CIRCUIT AND METHOD FOR DRIVING DATA LINES

(75) Inventor: Junya Yokota, Kanagawa (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 866 days.

(21) Appl. No.: 12/213,279

(22) Filed: Jun. 17, 2008

(65) Prior Publication Data

US 2009/0002406 A1 Jan. 1, 2009

(30) Foreign Application Priority Data

Jun. 28, 2007 (JP) ..... 2007-171153

(51) Int. Cl.
*G09G 3/36* (2006.01)

(52) U.S. Cl. ..... 345/100; 345/204

(58) Field of Classification Search ..... 345/690, 345/87, 98–100, 76, 82, 204
See application file for complete search history.

(56) References Cited

U.S. PATENT DOCUMENTS 5,534,885 A * 7/1996 Saitoh ..... 345/100
6,426,744 B2 7/2002 Hashimoto et al.
6,496,175 B1 * 12/2002 Fukuo ..... 345/99
6,756,962 B1 * 6/2004 Akimoto et al. ..... 345/98
7,486,267 B2 * 2/2009 Chen et al. ..... 345/98
7,522,142 B2 * 4/2009 Song ..... 345/98
2001/0013851 A1 8/2001 Hashimoto et al.
2005/0151714 A1 * 7/2005 Hirama ..... 345/100
2005/0156861 A1 * 7/2005 Song ..... 345/100

FOREIGN PATENT DOCUMENTS

CN 1211854 (A) 3/1999
JP 11-85113 3/1999
JP 2003-233358 8/2003

OTHER PUBLICATIONS

Chinese Office Action dated Nov. 9, 2011, with English translation.

* cited by examiner

*Primary Examiner* — Stephen Sherman

(74) *Attorney, Agent, or Firm* — McGinn Intellectual Property Law Group, PLLC

(57) ABSTRACT

A data line drive circuit includes a plurality of output circuits and a plurality of switch portions. The plurality of output circuits outputs voltages corresponding to grayscale voltages with respect to display data. The plurality of switch portions becomes an ON-state in response to a line output signal and connects the plurality of output circuits and a plurality of data lines, respectively. ON-resistance values of at least part of the plurality of switch portions vary in the ON-state.

2 Claims, 12 Drawing Sheets

LINE OUTPUT SIGNAL

CONTROL SIGNAL a
(AMPLIFIER BLOCKS A/B)

CONTROL SIGNAL b
(AMPLIFIER BLOCK A)

CONTROL SIGNAL c
(AMPLIFIER BLOCK B)

OUTPUT TIMING OF
AMPLIFIER BLOCK A
Rsw1A+Rsw2A

OUTPUT TIMING OF
AMPLIFIER BLOCK B
Rsw1B+Rsw2B
Rsw1B

LINE OUTPUT SIGNAL

CONTROL SIGNAL a
(AMPLIFIER BLOCKS A/B)

CONTROL SIGNAL b
(AMPLIFIER BLOCK A)

CONTROL SIGNAL c
(AMPLIFIER BLOCK A)

CONTROL SIGNAL d
(AMPLIFIER BLOCK B)

CONTROL SIGNAL e
(AMPLIFIER BLOCK B)

OUTPUT TIMING OF
AMPLIFIER BLOCK A
Rsw1A+Rsw2A+Rsw3A
Rsw1A+Rsw2A

OUTPUT TIMING OF
AMPLIFIER BLOCK B
Rsw1B+Rsw2B+Rsw3B
Rsw1B+Rsw2B
Rsw1B

DATA LINE DRIVE CIRCUIT AND METHOD FOR DRIVING DATA LINES

INCORPORATION BY REFERENCE

This application is based upon and claims the benefit of priority from Japanese patent application No. 2007-171153 filed on Jun. 28, 2007, the disclosure of which is incorporated herein in its entirety by reference.

BACKGROUND OF THE INVENTION

1. Field of the Invention

The present invention relates to a data line drive circuit which drives a display panel of a matrix type, a liquid crystal display device using the data line drive circuit, and a method for driving data lines.

2. Description of Related Art

In a liquid crystal panel of the liquid crystal display device of a matrix type, the scanning lines and the data lines are extended in a row direction and in a column direction, and pixels are arranged at intersections of the scanning lines and the data lines. Each pixel has an active element (Thin Film Transistor (TFT)). The gate electrode of the active element is connected to the scanning line, and the drain electrode is connected to the data line. Moreover, a liquid crystal capacitance that is equivalent to a capacitive load is connected to the source electrode of the active element, and another side of the liquid crystal capacitance is connected to a common electrode line.

In the liquid crystal display device, in order to drive the scanning lines and the data lines of the liquid crystal panel, a scanning line drive circuit and a data line drive circuit are provided. The scanning line is scanned sequentially from the top to the bottom by the scanning line drive circuit. At this time, a voltage is applied to the liquid crystal capacitance from the data line drive circuit through the active element arranged at each pixel. In the liquid crystal display device, based on the voltage applied to the liquid crystal capacitance, alignment of the liquid crystal molecules changes and the transmissivity of light changes. This change of transmissivity enables color display having grayscale.

In the liquid crystal display device, there is known an alternating current drive method in which a polarity of a voltage (hereinafter referred to as a "pixel voltage") applied to the liquid crystal capacitance from the data line through the TFT is inverted for every predetermined period. That is, the pixel is driven by an alternating current manner. Here, the polarity means a polarity of the pixel voltage based on a voltage (Vcom) of the common electrode line of the liquid crystal. This is because it is preferable for the pixels to be driven by the alternating current manner, since if a voltage with a fixed polarity is applied to the liquid crystal capacitance, physical characteristics of the liquid crystal molecules will degrade with a lapse of time. As a method for realizing such alternating current driving, there are known the dot inversion drive system where a polarity of the pixel voltage is inverted each time one scanning line is scanned, a two-line dot inversion drive system where a polarity of the pixel voltage is inverted each time two scanning lines are scanned and so on.

Since the voltage applied to the pixel in the inversion drive system is an alternating voltage centering to Vcom, a voltage range for driving is large. These voltages are supplied from the data line drive circuit, and the data line drive circuit consumes a large amount of electric power for driving the liquid crystal display device.

Moreover, along with upsizing of the liquid crystal panel and increasing number of outputs of the data line drive circuit, the data line drive circuit increases its power consumption remarkably.

In a typical data line drive circuit, the liquid crystal panel is driven with all the outputs therefrom being in the same timing. Then, currents concentrate on a same timing and a large current flows instantaneously. In this way, a large EMI (Electro-Magnetic Interference) noise occurs at a moment. In order to reduce this EMI noise, reducing concentration of the currents is needed.

We have now discovered the followings.

As a related art of reducing concentration of currents, a data line drive circuit is described in Japanese Laid-Open Patent Application JP-P 2003-233358A. Referring to FIG. 1, the data line drive circuit is provided with a multi-output amplifier circuit and a delay circuit. The multi-output amplifier circuit is divided into a left amplifier block and a right amplifier block. The operation timings of this data line drive circuit are shown in FIGS. 2A to 2C. When a line output signal shown in FIG. 2A is supplied, the left amplifier block is driven in synchronization with the line output signal as shown in FIG. 2B, and the right amplifier block is driven by a signal obtained by delaying the line output signal in the delay circuit. Thus, by shifting the operation timings of a plurality of amplifier blocks, the concentration of currents can be reduced and the EMI noise can be reduced.

However, since the amplifier blocks execute charging at respective different timings with a fixed time constant, when looking at the amplifier blocks at a certain timing, there is a case where a waveform is fully risen up in the left amplifier block having an early operation timing whereas a waveform is not fully risen up in the right amplifier block having a delayed operation timing. Such a case gives rise to a voltage difference between the right amplifier block and the left amplifier block, and display unevenness occurs as a result. Moreover, recently, there is a panel for a liquid crystal TV using 120-Hz driving. In this liquid crystal display device, since a period when the liquid crystal is charged from the amplifier block decreases to a half of the typical case, a trend of the device to easily generate display unevenness due to the above-mentioned difference of the charging timing becomes more remarkable.

Furthermore, in the liquid crystal display device, there is a case where collection of charges may be conducted in order to curtail power consumption. The collection of charges must be completed before the line output signal falls to a "L" level again after it rose to a "H" level. However, in a related technique, charging is conducted at the different timing and with the fixed time constant. Therefore, there is a case as follows: if the fixed time is secured in order to collect charges, the next period to drive the pixels starts; if the charge collection operation is started earlier, the outputs of the amplifiers may cause electrical shorting through the liquid crystal load. In order to prevent this, the charge collection period must be shortened, and as a result the amount of charges to charge the liquid crystal load increases, which leads to an increase of consumed electric current. This will be contrary to reduction of the EMI noise.

Moreover, an apparatus for driving a liquid crystal is disclosed in Japanese Laid-Open Patent Application JP-A-Heisei 11-85113. Referring to FIG. 3, in this related application, two kinds of switches S1 and S2 that are different in an ON-resistance value are provided at an output of an output circuit. The switches S1 and S2 are switched in response to signals C3 and C4 from the outside and a strobe signal STB. For this reason, even if the control is done with a maximum fineness, the control can be done only for each line, and this application has a same problem as the above-mentioned JP-P 2003-233358A.

SUMMARY

The present invention seeks to solve one or more of the above problems, or to improve upon those problems at least in part. In one embodiment, a data line drive circuit includes: a plurality of output circuits configured to output voltages corresponding to grayscale voltages with respect to display data; a plurality of switch portions configured to become a ON-state in response to a line output signal and connect the plurality of output circuits and a plurality of data lines, respectively. ON-resistance values of at least part of the plurality of switch portions vary in the ON-state.

In the present invention, since the ON-resistance values of at least part of the plurality of switch portions vary in the ON-state, the peaks of the drive currents flowing in the data lines can be temporally dispersed. Therefore, the peak value of total drive current can be suppressed. As a result, the EMI noise can be reduced.

In another embodiment, a liquid crystal display device includes: a display panel configured to includes a plurality of data lines; and a data line drive circuit configured to drive the plurality of data lines. The data line drive circuit includes: a plurality of output circuits configured to output voltages corresponding to grayscale voltages with respect to display data, and a plurality of switch portions configured to become a ON-state in response to a line output signal and connect the plurality of output circuits and the plurality of data lines, respectively. ON-resistance values of at least part of the plurality of switch portions vary in the ON-state.

Similar to the data line drive circuit, above-mentioned operation and effect can be obtained in the present invention.

In another embodiment, a method for driving data lines, includes: generating a plurality of control signals in response to a line output signal; putting a plurality of switch portions into ON-state in response to a first portion of the plurality of control signals; connecting a plurality of output circuits and a plurality of data lines, respectively, wherein the plurality of output circuits outputs voltages corresponding to grayscales with respect to display data; and varying ON-resistance values of the plurality of switch portions in response to a second portion of the plurality of control signals.

Similar to the data line drive circuit, above-mentioned operation and effect can be obtained in the present invention.

BRIEF DESCRIPTION OF THE DRAWINGS

The above and other objects, advantages and features of the present invention will be more apparent from the following description of certain preferred embodiments taken in conjunction with the accompanying drawings, in which.

DESCRIPTION OF THE PREFERRED EMBODIMENTS

The invention will be now described herein with reference to illustrative embodiments. Those skilled in the art will recognize that many alternative embodiments can be accomplished using the teachings of the present invention and that the invention is not limited to the embodiments illustrated for explanatory purposed.

Figure 1:
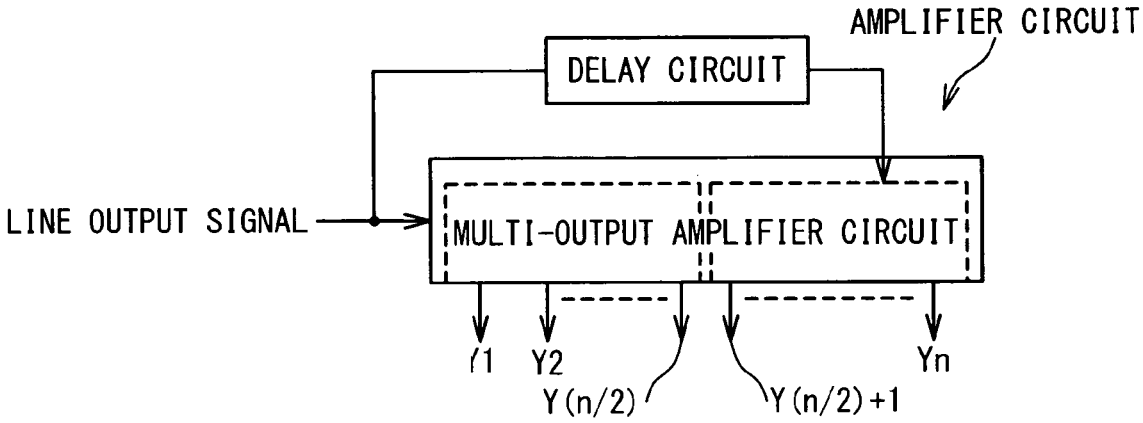
FIG. 1 is a view showing a configuration of a typical liquid crystal drive circuit.
Figures 2A, 2B, 2C:
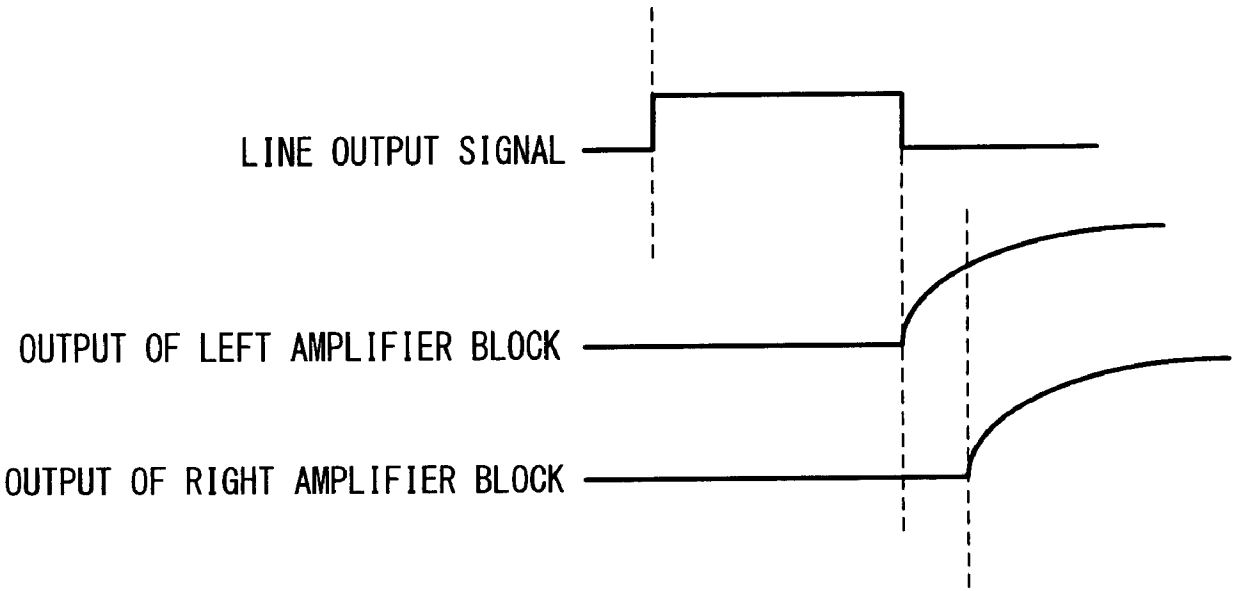
FIGS. 2A to 2C are views showing timing charts of an operation of the typical liquid crystal drive circuit shown in FIG. 1.
Figure 3:
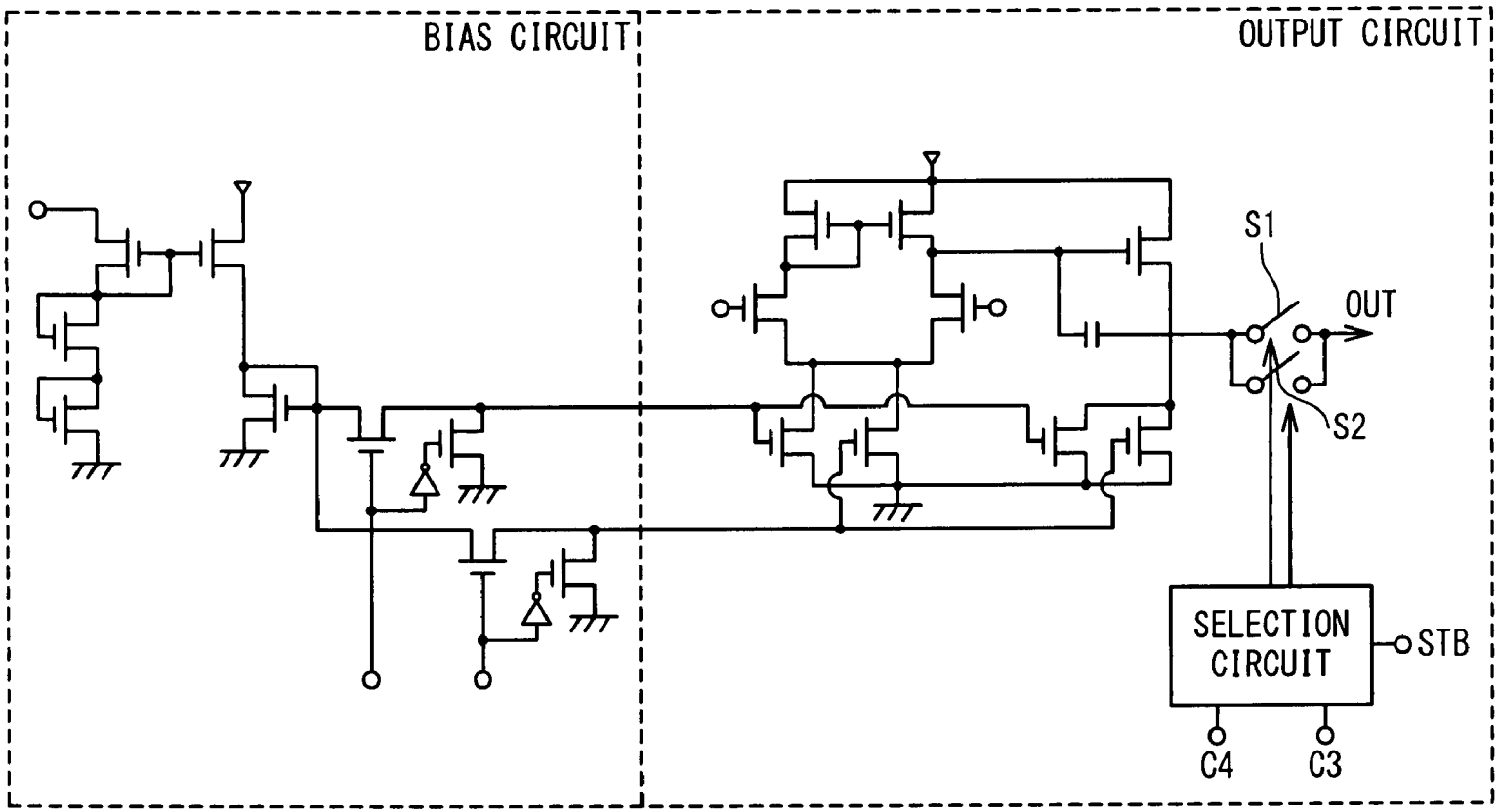
FIG. 3 is a view showing a configuration of another typical liquid crystal drive circuit.
Figure 4:
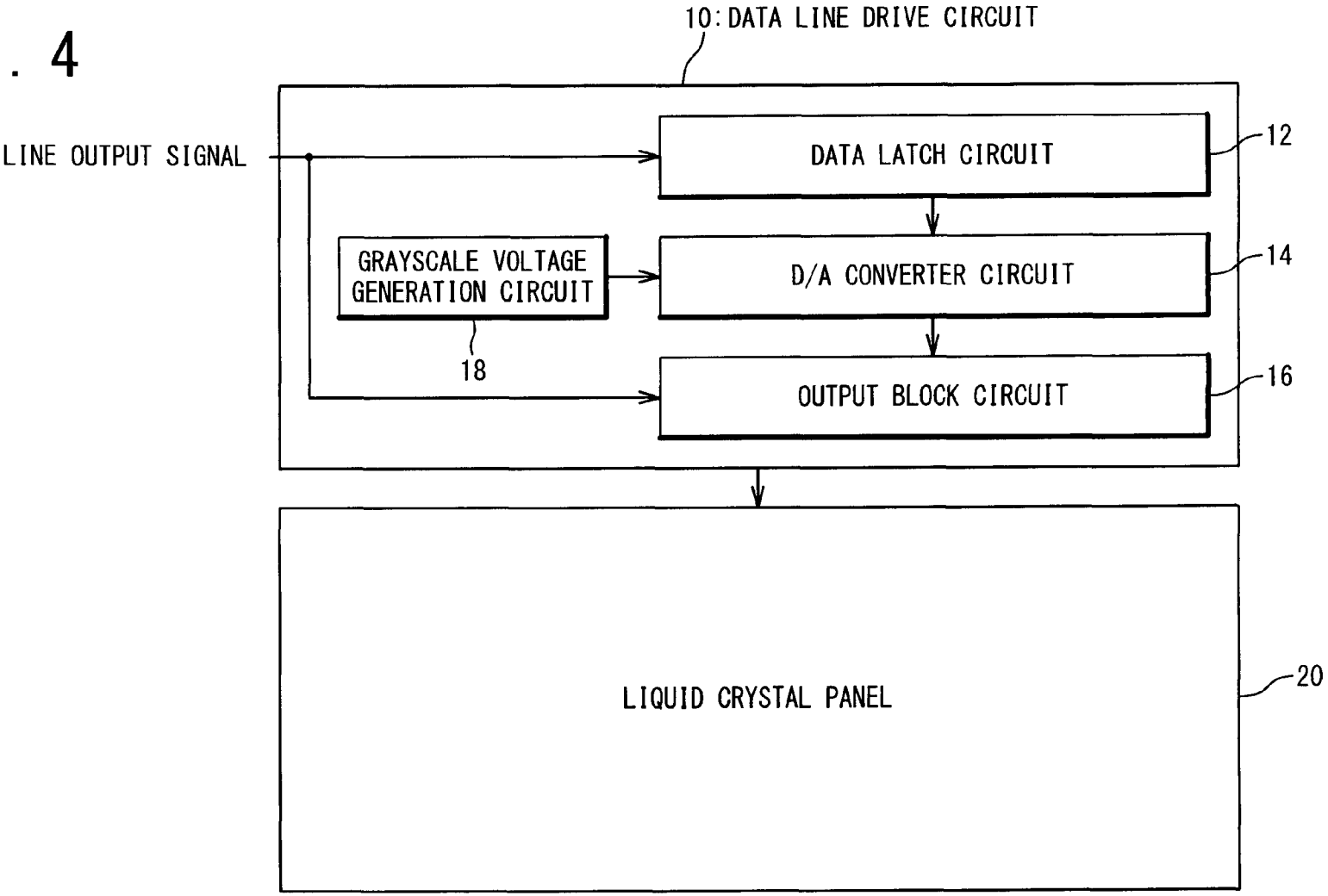
FIG. 4 is a view showing a configuration of a liquid crystal display device according to the present invention.

FIG. 4 is a view showing a liquid crystal display device according to a first embodiment of the present invention. Referring to FIG. 4, the display device includes a data line drive circuit 10 and a liquid crystal panel 20. The data line drive circuit 10 includes a data latch circuit 12, a D/A converter circuit 14, an output block circuit 16, and a grayscale voltage generation circuit 18. The liquid crystal panel 20 includes pixels provided at intersections of a plurality of scanning lines extended in a row direction and a plurality of data lines extended in a column direction. A configuration of the liquid crystal panel 20 is the same as that of the typical (conventional) example.

The data latch circuit 12 holds pixel data for one row, and outputs the pixel data to the D/A converter circuit 14 in response to a line output signal. The grayscale voltage generation circuit 18 creates voltages corresponding to grayscale levels, and outputs them to the D/A converter circuit 14. The D/A converter circuit 14 converts each of the pixel data into a corresponding analog grayscale voltage, and outputs these analog grayscale voltage to the output block circuit 16. The output block circuit 16 drives the data lines based on the grayscale voltages. By this operation, the pixel data are displayed on the liquid crystal panel 20 corresponding to the row.

Figure 5:
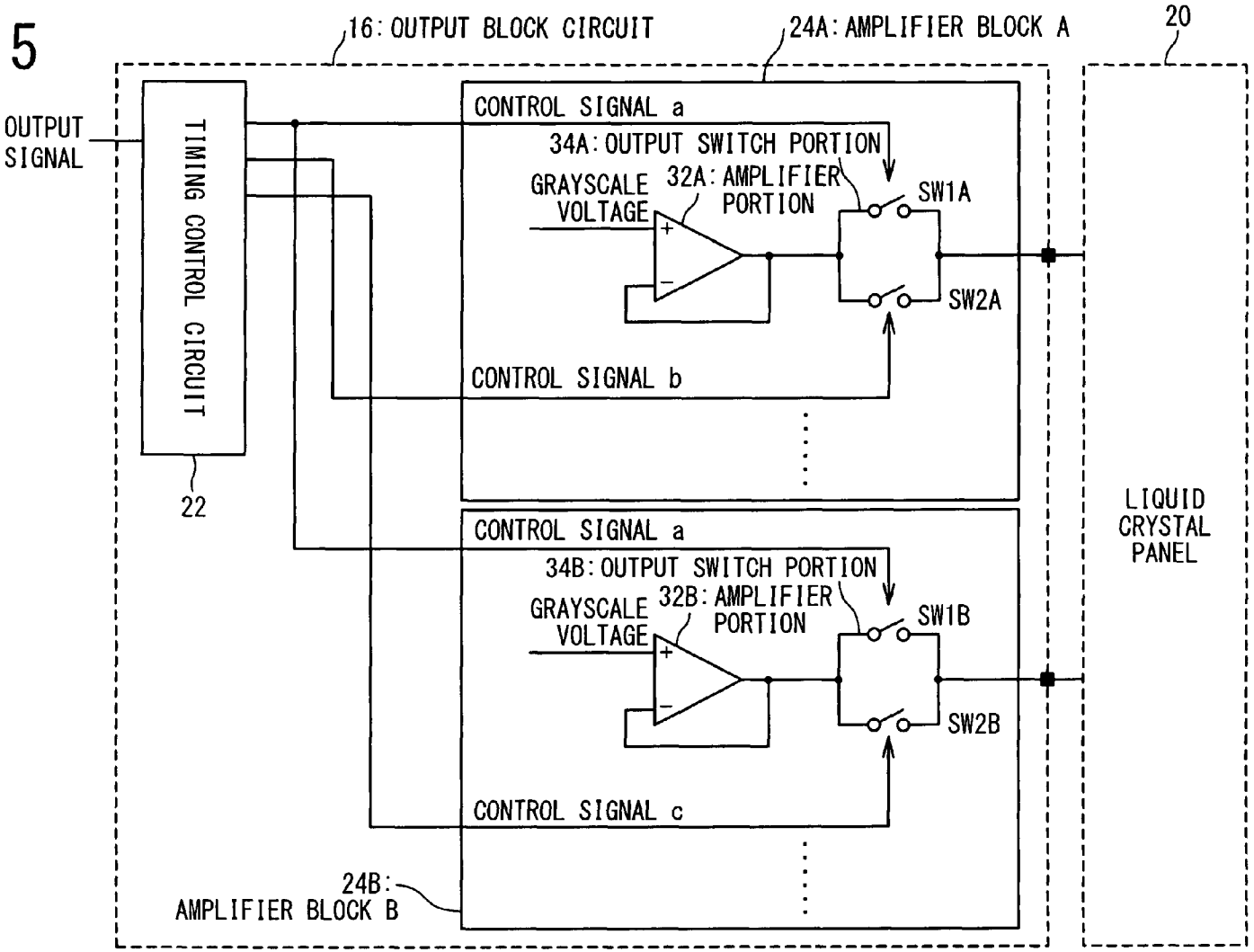
FIG. 5 is a block diagram showing a configuration of an output block circuit of the liquid crystal drive circuit according to a first embodiment of the present invention.

FIG. 5 is a block diagram showing a configuration of the output block circuit 16 of the data line drive circuit 10 according to the first embodiment of the present invention. Referring to FIG. 5, the output block circuit 16 includes a timing control circuit 22 and an amplifier block (A, B). The timing control circuit 22 creates control signal a, b, and c in response to the line output signal. The amplifier block includes a plurality of amplifier blocks. The number of the amplifier blocks is arbitrary. In this example, a single line of the amplifier block is divided into two: an amplifier block A 24A and an amplifier block B 24B. That is, the output block circuit 16 includes two amplifier blocks (24A and 24B). However, in the present invention, a division number is not limited to two.

The amplifier block A 24A includes an amplifier portion 32A and an output switch portion 34A. A set of the amplifier portion 32A and the output switch portion 34A is provided correspondingly to each of the data lines connected to the amplifier block A 24A. The amplifier portion 32A amplifies a grayscale voltage outputted from the D/A converter circuit 14, and outputs it to the output switch portion 34A. The output switch portion 34A is connected to the amplifier portion 32A, and connects a corresponding data line of the liquid crystal panel 20 to the amplifier portion 32A. The output switch portion 34A includes a switch SW1A and a switch SW2A that are connected in parallel to each other. The switch SW1A is normally turned off, and begins to be turned on in response to the control signal a. At the time of an OFF-state, the switch SW1A provides electrical isolation between the amplifier portion 32A and the data line. At the time of an ON-state, the switch SW1A has a predetermined resistance value. The switch SW2A is normally turned off, and begins to be turned on in response to the control signal b. At the time of the OFF-state, the switch SW2A provides electrical isolation between the amplifier portion 32A and the data line. At the time of the ON-state, the switch SW2A has a predetermined resistance value. It is preferable that the resistance value of the switch SW1A at the time of the ON-state is larger than that of the switch SW2A at the time of the ON-state. However, the present invention is not limited to this configuration.

The amplifier block B 24B includes an amplifier portion 32B and an output switch portion 34B. A set of the amplifier portion 32B and the output switch portion 34B is provided correspondingly to each of the data lines connected to the amplifier block B 24B. The amplifier portion 32B amplifies the grayscale voltage outputted from the D/A converter circuit 14, and outputs it to the output switch portion 34B. The output switch portion 34B is connected to the amplifier portion 32B, and connects the corresponding data line of the liquid crystal panel 20 to the amplifier portion 32B. The output switch portion 34B has a same configuration as that of the output switch portion 34A, and includes a switch SW1B and a switch SW2B that are connected in parallel to each other. The switch SW1B is normally turned off, and begins to be turned on in response to the control signal a. At the time of the OFF-state, the switch SW1B provides electrical isolation between the amplifier portion 32B and the data line. At the time of the ON-state, the switch SW1B has a predetermined resistance value. The switch SW2B is normally turned off, and begins to be turned on in response to the control signal c. At the time of the OFF-state, the switch SW2B provides electrical isolation between the amplifier portion 32B and the data line. At the time of the ON-state, the switch SW2B has a predetermined resistance value. It is preferable that the resistance value of the switch SW1B at the time of the ON-state is larger than that of the switch SW2B at the time of the ON-state. Note that it is preferable that the resistance value of the SW1B at the time of the ON-state is equal to that of the SW1A at the time of the ON-state, and the resistance value of the SW2B at the time of the ON-state is equal to that of the SW2A at the time of the ON-state. However, the present invention is not limited to this configuration.

Figures 6A, 6B, 6C, 6D, 6E, 6F:
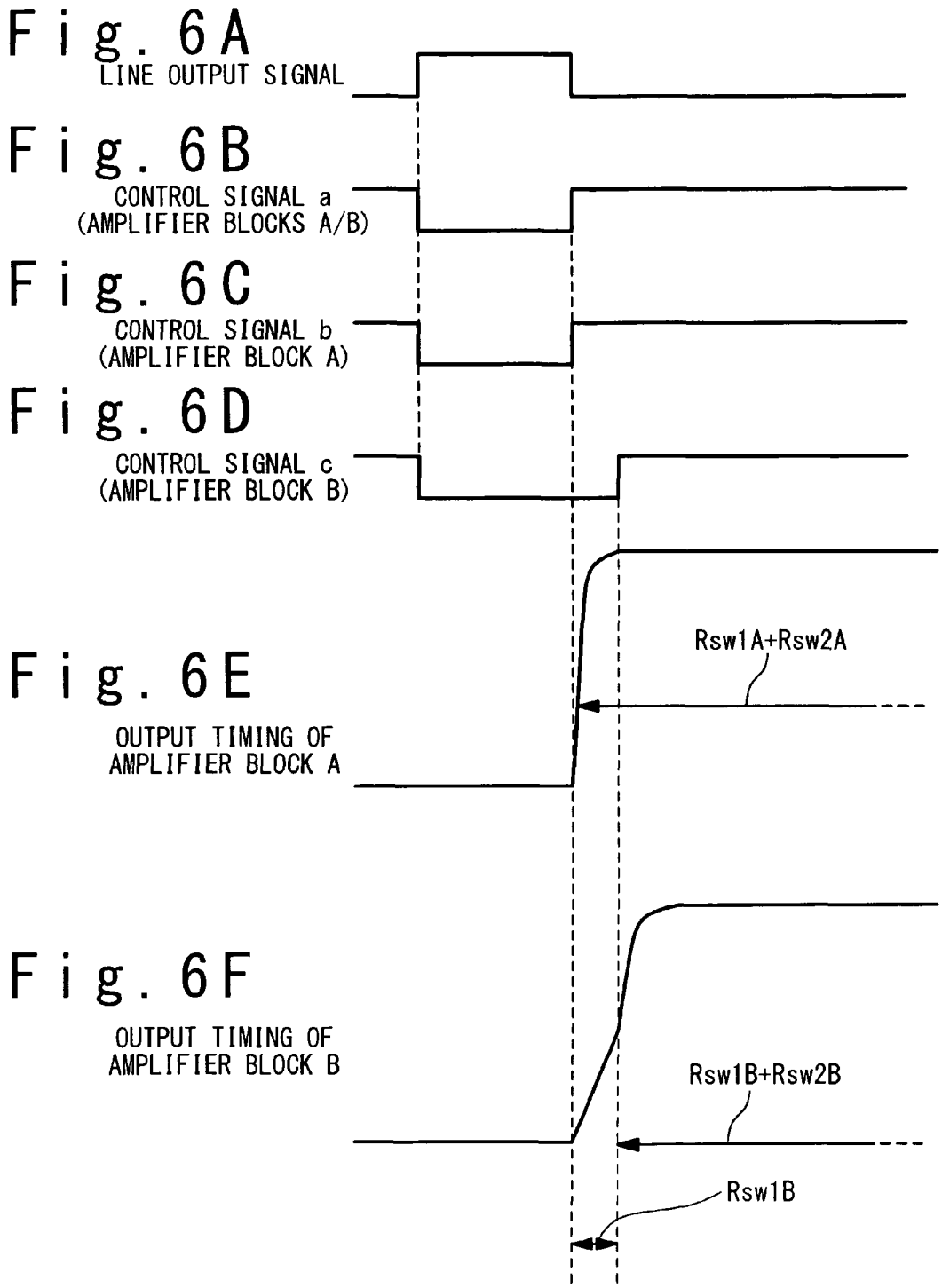
FIGS. 6A to 6F are views showing timing charts of an operation of the output block circuit of the liquid crystal drive circuit according to the first embodiment of the present invention.

FIGS. 6A to 6F are views showing timing charts of waveforms of parts of the data line drive circuit according to the first embodiment of the present invention. The line output signal is supplied from the outside of the output block circuit 16 of the data line drive circuit 10. As shown in FIG. 6A, the line output signal is a signal that changes from a "L" level to a "H" level, and after that changes to the "L" level again. The timing control circuit 22 creates the control signal a, b, and c from the line output signal. As shown in FIGS. 6B to 6D, the control signals a to c fall in synchronization with a rise of the line output signal. The control signals a, b rise in synchronization with falling of the line output signal, and the control signal c rises being delayed from the falling of the line output signal. In this way, after the falling of the line output signal, the data line is driven to a voltage corresponding to a grayscale level of a pixel within a predetermined time.

At this time, in the first embodiment, the control signals a and b are simultaneously supplied to the switch SW1A and the switch SW2A, respectively, in synchronization with the falling of the line output signal. In this way, the both switches turn on. As a result, as shown in FIG. 6E, an output voltage from the amplifier block A 24A rises steeply in synchronization with the falling of the line output signal.

Moreover, in synchronization with the falling of the line output signal, the control signal a is simultaneously supplied to the switch SW1B. In this way, the switch SW1B having a high resistance value turns on. However, at this time, the control signal c is still in the "L" level, and the switch SW2B is still in the OFF-state. As a result, as shown in FIG. 6F, an output voltage from the amplifier block B 24B will rise slowly. After a while, when the control signal c has fully risen, the switch SW2B of the low resistance value will be turned on. In this way, since a resistance value of the switch portion 34B falls, the output voltage from the amplifier block B 24B rises abruptly.

In the above explanation, when the output voltage of the amplifier block rises abruptly, a large current will flow. If only one data line is driven, the current does not amount to a great value. However, when a large number of the data lines are driven simultaneously, a large current will flow. Since an EMI noise corresponds to a temporal variation of a current, when a large number of the data lines are driven simultaneously, the large EMI noise will occur. However, by shifting the timings of the currents that flow in order to charge the data line like the present invention, a peak value of the current can be held down and it becomes possible to reduce the EMI noise as a result.

Moreover, when the switch 34A is turned on and have a low resistance value in the amplifier block A; in the amplifier block B, although being in a high resistance state, the switch portion 34B is also turned on. For this reason, a time difference after the line output signal falls until the control signal c rises is much shorter than the time corresponding to a display cycle of the data. As a result, a noise can be reduced without causing deterioration of display quality.

Incidentally, in this example, the amplifier block is divided into two amplifier blocks. The plurality of the data lines is also divided into two groups. The data lines in one group are connected to the amplifier block A 24A. The data lines in the other group are connected to the amplifier block B 24B. In this case, the data lines corresponding to the amplifier block A may be arranged in a bundle, and the data lines corresponding to the amplifier block B may be arranged in another bundle. The data line corresponding to the amplifier block A and the data line corresponding to the amplifier block B may be alternately arranged.

Figure 7:
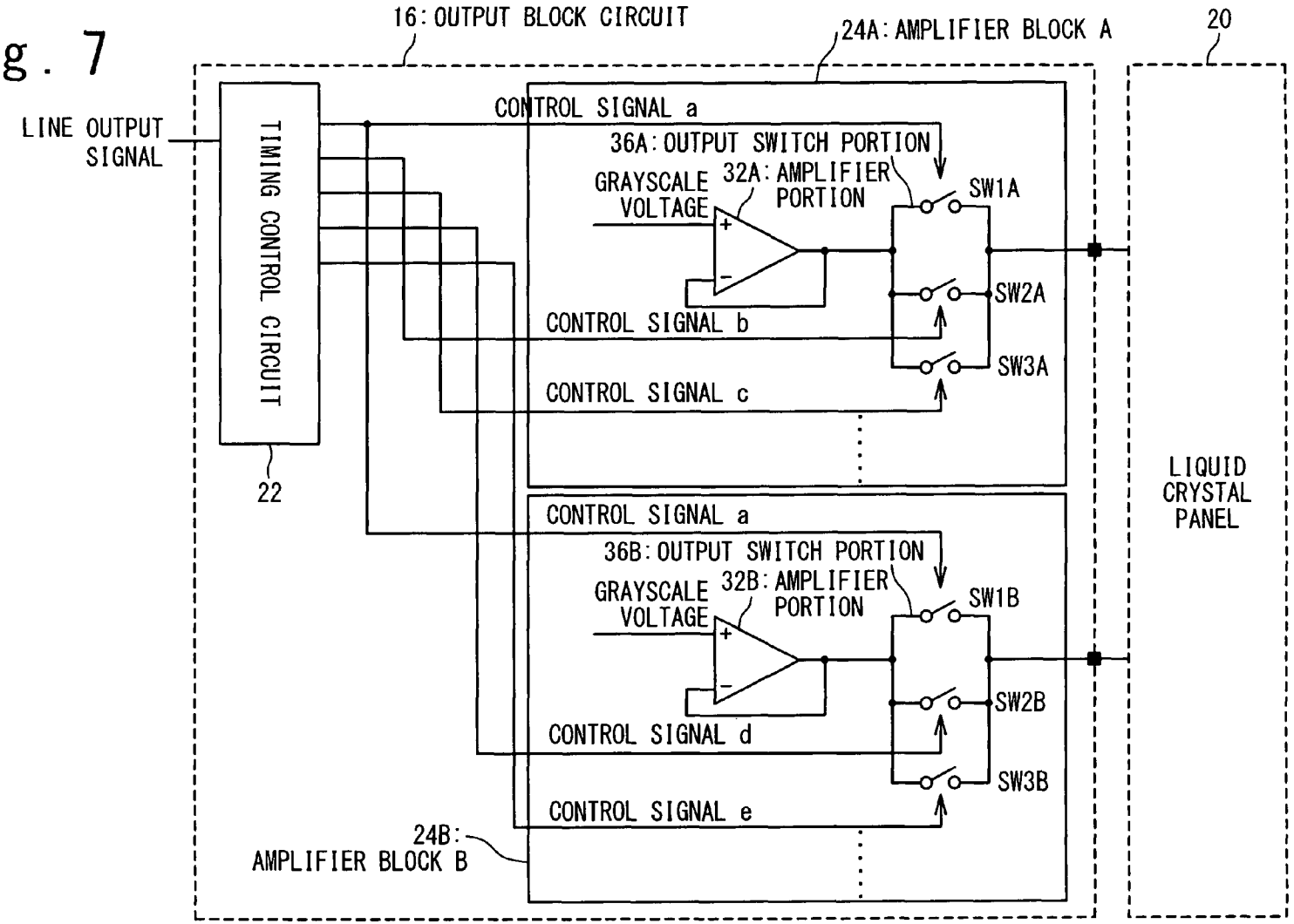
FIG. 7 is a block diagram showing a configuration of an output block circuit of a liquid crystal drive circuit according to a second embodiment of the present invention.

FIG. 7 is a block diagram showing a configuration of the output block circuit 16 of the data line drive circuit 10 according to a second embodiment of the present invention. Referring to FIG. 7, the output block circuit 16 includes a timing control circuit 22 and an amplifier block (A, B). The timing control circuit 22 creates control signals a to e in response to the line output signal. The amplifier block includes a plurality of amplifier blocks. The number of the amplifier blocks is arbitrary. In this example, a single line of the amplifier block is divided into two: an amplifier block A 24A and an amplifier block B 24B. That is, the output block circuit 16 includes two amplifier blocks (24A and 24B). However, in the present invention, a division number is not limited to two.

The amplifier block A 24A includes an amplifier portion 32A and an output switch portion 36A. A set of the amplifier portion 32A and the output switch portion 36A is provided correspondingly to each of the data lines connected to the amplifier block A 24A. The amplifier portion 32A amplifies the grayscale voltage outputted from the D/A converter circuit 14, and outputs it to the output switch portion 36A. The output switch portion 36A is connected to the amplifier portion 32A, and connects the corresponding data line of the liquid crystal panel 20 to the amplifier portion 32A. The output switch portion 36A includes a switch SW1A, a switch SW2A, and a switch SW3A that are connected in parallel to each other. The switch SW1A is normally turned off, and begins to be turned on in response to the control signal a. At the time of the OFF-state, the switch SW1A provides electrical isolation between the amplifier portion 32A and the data line. At the time of the ON-state, the switch SW1A has a first resistance value. The switch SW2A is normally turned off, and begins to be turned on in response to the control signal b. At the time of the OFF-state, the switch SW2A provides electrical isolation between the amplifier portion 32A and the data line. At the time of the ON-state, the switch SW2A has a second resistance value. The switch SW3A is normally turned off, and begins to be turned on in response to the control signal c. At the time of the OFF-state, the switch SW3A provides electrical isolation between the amplifier portion 32A and the data line. At the time of the ON-state, the switch SW3A has a third resistance value. It is preferable that a first resistance value of the switch SW1A at the time of the ON-state is larger than a second resistance value of the switch SW2A at the time of the ON-state, and the second resistance value of the switch SW2A at the time of the ON-state is larger than a third resistance value of the switch SW3A at the time of the ON-state. However, the present invention is not limited to this configuration.

The amplifier block B 24B includes an amplifier portion 32B and a switch portion 36B. A set of the amplifier portion 32B and the output switch portion 36B is provided correspondingly to each of the data lines connected to the amplifier block B 24B. The amplifier portion 32B amplifies the grayscale voltage outputted from the D/A converter circuit 14, and outputs it to the output switch portion 36B. The output switch portion 36B is connected to the amplifier portion 32B, and connects the corresponding data line of the liquid crystal panel 20 to the amplifier portion 32B. The output switch portion 36B includes a switch SW1B, a switch SW2B, and a switch SW3B that are connected in parallel to each other.

The switch SW1B is normally turned off, and begins to be turned on in response to the control signal a. At the time of the OFF-state, the switch SW1B provides electrical isolation between the amplifier portion 32B and the data line. At the time of the ON-state, the switch SW1B has the first resistance value. The switch SW2B is normally turned off, and begins to be turned on in response to the control signal d. At the time of the OFF-state, the switch SW2B provides electrical isolation between the amplifier portion 32B and the data line. At the time of the ON-state, the switch SW2B has the second resistance value. The switch SW3B is normally turned off, and begins to be turned on in response to a control signal e. At the time of the OFF-state, the switch SW3B provides electrical isolation between the data line and the amplifier portion 32B. At the time of the ON-state, the switch SW3B has the third resistance value. It is preferable that the first resistance value of the SW1B at the time of the ON-state is larger than the second resistance value of the SW2B at the time of the ON-state, and the second resistance value of the SW2B at the time of the ON-state is larger than the third resistance value of the SW3B at the time of the ON-state. Note that it is preferable that the first resistance value of the SW1B at the time of the ON-state is equal to the first resistance value of the SW1A at the time of the ON-state, the second resistance value of the SW2B at the time of the ON-state is equal to the second resistance value of the SW2A at the time of the ON-state, and the third resistance value of the SW3B at the time of the ON-state is equal to the third resistance value of the SW3A at the time of the ON-state. However, the present invention is not limited to this configuration.

Figures 8A, 8B, 8C, 8D, 8E, 8F, 8G, 8H:
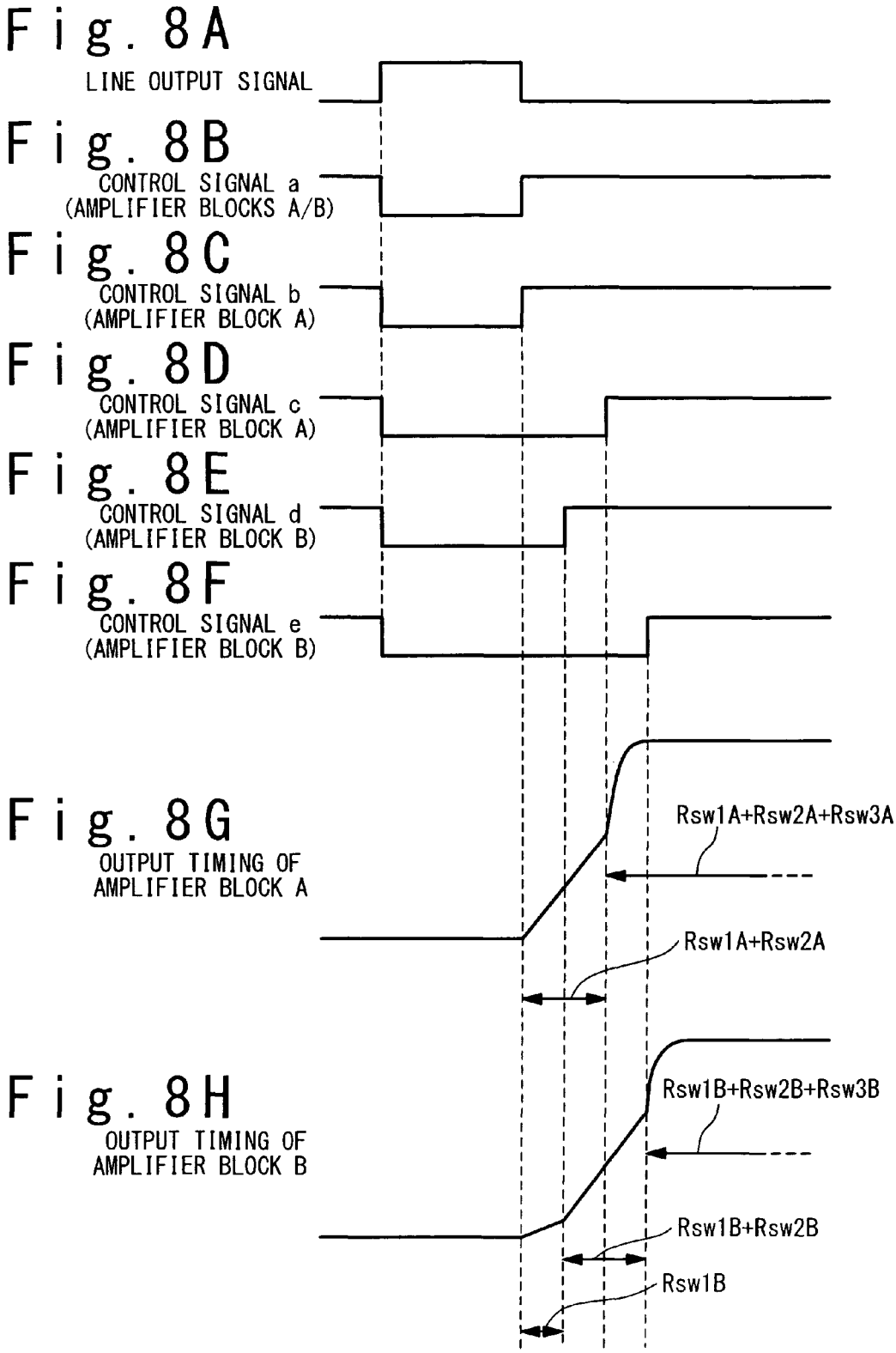
FIGS. 8A to 8H are views showing timing charts of an operation of the output block circuit of the liquid crystal drive circuit according to the second embodiment of the present invention.

FIGS. 8A to 8H are views showing timing charts of waveforms of parts of the data line drive circuit according to the second embodiment of the present invention. The line output signal is supplied from the outside of the output block circuit 16 of the data line drive circuit 10. As shown in FIG. 8A, the line output signal is a signal that rises from the "L" level to the "H" level, and subsequently falls to the "L" level again. The timing control circuit 22 creates the control signals a to e from the line output signal. As shown in FIGS. 8B to 8F, the control signals a to e fall in synchronization with the rise of the line output signal. The control signals a, b rise in synchronization with the falling of the line output signal. The control signal c rises being delayed from the falling of the line output signal. Although the control signal d is delayed from the falling of the line output signal, it rises before the control signal c rises. The control signal e is delayed from the falling of the line output signal, and rises after the control signal c has risen. In this way, after the falling of the line output signal, the data line is driven to a voltage corresponding to the grayscale level of the pixel within a predetermined time.

Thus, in the second embodiment, the control signals a and b are simultaneously supplied to the switches SW1A and SW2A in synchronization with the falling of the line output signal. The above process turns on the both switches. As a result, as shown in FIG. 8G, the output voltage from the amplifier block A 24A rises abruptly in synchronization with the falling of the line output signal. Then, when the control signal c rises, the switch SW3A will be turned on and the third resistance value will be connected to the amplifier portion 32A. As a result, the output voltage of the amplifier block A will rise still more steeply.

Moreover, in synchronization with the falling of the line output signal, the control signal a is simultaneously supplied to the switch SW1B. In this way, the switch SW1B having the first resistance value is turned on. However, at this time, the control signals d and e are still in the "L" level, and the switches SW2B and SW3B are still in the OFF-state. As a result, as shown in FIG. 8H, the output voltage from the amplifier block B 24B will rise slowly. After a lapse of some time, when the control signal d has risen before the control signal c rises, the switch SW2B of the second resistance value will be turned on. In this way, since a resistance value of the switch portion 36B falls, the output voltage from the amplifier block B 24B begins to rise abruptly. Then, when the control signal e rises after the control signal c has risen, the switch SW3B will be turned on and the third resistance value will be connected. As a result, the output voltage of the amplifier block B will rise still more steeply.

In the above explanation, the data line drive circuit of the second embodiment can attain the same effect as the first embodiment of the present invention. In addition, since the number of the switches connected in parallel to the switch portion have increased, the currents for charging the data lines can be averaged to have less variation, and also the EMI noise can be reduced.

Incidentally, in this example, the amplifier block is divided into two amplifier blocks. The plurality of the data lines is also divided into two groups. The data lines in one group are connected to the amplifier block A 24A. The data lines in the other group are connected to the amplifier block B 24B. In this case, the data lines corresponding to the amplifier block A may be arranged in a bundle, and the data lines corresponding to the amplifier block B may be arranged in another bundle. The data line corresponding to the amplifier block A and the data line corresponding to the amplifier block B may be alternately arranged.

Figure 9:
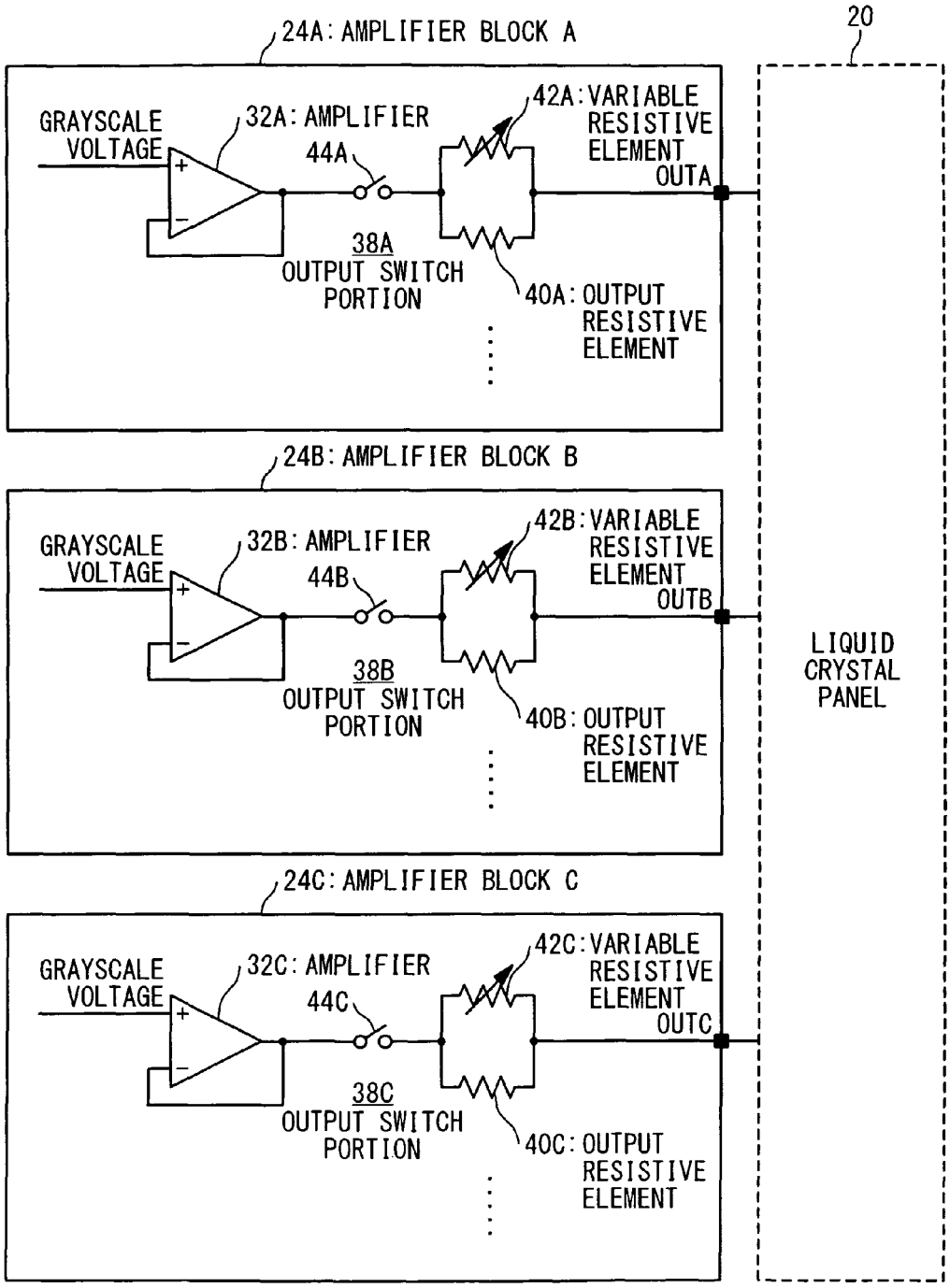
FIG. 9 is a block diagram showing a configuration of an output block circuit of a liquid crystal drive circuit according to a third embodiment of the present invention.

FIG. 9 is a block diagram showing a configuration of the output block circuit 16 of the data line drive circuit 10 according to a third embodiment of the present invention. Referring to FIG. 9, the output block circuit 16 includes a timing control circuit 22 (not shown) which is the same as that in FIG. 7 and an amplifier block (A, B, and C). The timing control circuit 22 creates control signals a1, a2, b1, b2, c1, c2, d, e, and f (not shown) in response to the line output signal. The amplifier block includes a plurality of amplifier blocks. The number of the amplifier blocks is arbitrary. In this example, a single line of the amplifier block is divided into three: an amplifier block A 24A, an amplifier block B 24B and an amplifier C 24C. That is, the output block circuit 16 includes three amplifier blocks (24A, 24B and 24C). However, in the present invention, the division number is not limited to three.

The amplifier block A 24A includes an amplifier portion 32A and an output switch portion 38A. A set of the amplifier portion 32A and the output switch portion 38A is provided correspondingly to each of the data lines connected to the amplifier block A 24A. The amplifier portion 32A amplifies the grayscale voltage outputted from the D/A converter circuit 14, and outputs it to the output switch portion 38A. The output switch portion 38A is connected to the amplifier portion 32A, and connects the corresponding data line of the liquid crystal panel 20 to the amplifier portion 32A. The output switch portion 38A includes a switch 44A and a parallel circuit. The switch 44A is connected in series to the parallel circuit. The parallel circuit includes an output resistive element 40A and a variable resistive element 42A that are connected in parallel to each other. The switch 44A is normally turned off, and begins to be turned on in response to the control signal d (not shown). At the time of the OFF-state, the switch 44A provides electrical isolation between the amplifier portion 32A and the data line. At the time of the ON-state, the switch 44A establishes electrical connection between the amplifier portion 32A and the data line. It is preferable that the output resistive element 40A has a fixed resistance value; In addition, it may be preferable that the resistance value varies depending on a current that flows therein in terms of the operation. The resistance value of the variable resistive element 42A can vary from a resistance value comparable to that of the output resistive element 40A to a resistance value smaller than that of the output resistive element 40A. However, the present invention is not limited to this configuration.

The amplifier block B 24B includes an amplifier portion 32B and a switch portion 38B. A set of the amplifier portion 32B and the output switch portion 38B is provided correspondingly to each of the data lines connected to the amplifier block B 24B. The amplifier portion 32B amplifies the grayscale voltage outputted from the D/A converter circuit 14, and outputs it to the output switch portion 38B. The output switch portion 38B is connected to the amplifier portion 32B, and connects the corresponding data line of the liquid crystal panel 20 to the amplifier portion 32B. The output switch portion 38B includes a switch 44B and a parallel circuit. The switch 44B is connected in series to the parallel circuit. The parallel circuit includes an output resistive element 40B and a variable resistive element 42B that are connected in parallel to each other. The switch 44B is normally turned off, and begins to be turned on in response to the control signal e (not shown). At the time of the OFF-state, the switch 44B provides electrical isolation between the amplifier portion 32B and the data line. At the time of the ON-state, the switch 44B establishes electrical connection between the amplifier portion 32B and the data line. It is preferable that the output resistive element 40B has a fixed resistance value. In addition, it may be preferable that the resistance value varies depending on a current that flows therein in terms of the operation. The resistance value of the variable resistive element 42B can vary from a resistance value comparable to that of the output resistive element 40B to a resistance value smaller than that of the output resistive element 40B. However, the present invention is not limited to this configuration.

The amplifier block C 24C includes an amplifier portion 32C and a switch portion 38C. A set of the amplifier portion 32C and the output switch portion 38C is provided correspondingly to each of the data lines connected to the amplifier block C 24C. The amplifier portion 32C amplifies the grayscale voltage outputted from the D/A converter circuit 14, and outputs it to the output switch portion 38C. The output switch portion 38C is connected to the amplifier portion 32C, and connects the corresponding data line of the liquid crystal panel 20 to the amplifier portion 32C. The output switch portion 38C includes a switch 44C and a parallel circuit. The switch 44C is connected in series to the parallel circuit. The parallel circuit includes an output resistive element 40C and a variable resistive element 42C that are connected in parallel to each other. The switch 44C is normally turned off, and begins to be turned on in response to the control signal f (not shown). At the time of the OFF-state, the switch 44C provides electrical isolation between the amplifier portion 32C and the data line. At the time of the ON-state, the switch 44C establishes electrical connection between the amplifier portion 32C and the data line. It is preferable that the output resistive element 40C has a fixed resistance value. In addition, it may be preferable that the resistance value varies depending on a current that flows therein in terms of the operation. The resistance value of the variable resistive element 42C can vary from a resistance value comparable to that of the output resistive element 40C and to a resistance value smaller than that of the output resistive element 40C. However, the present invention is not limited to this configuration.

Figure 10:
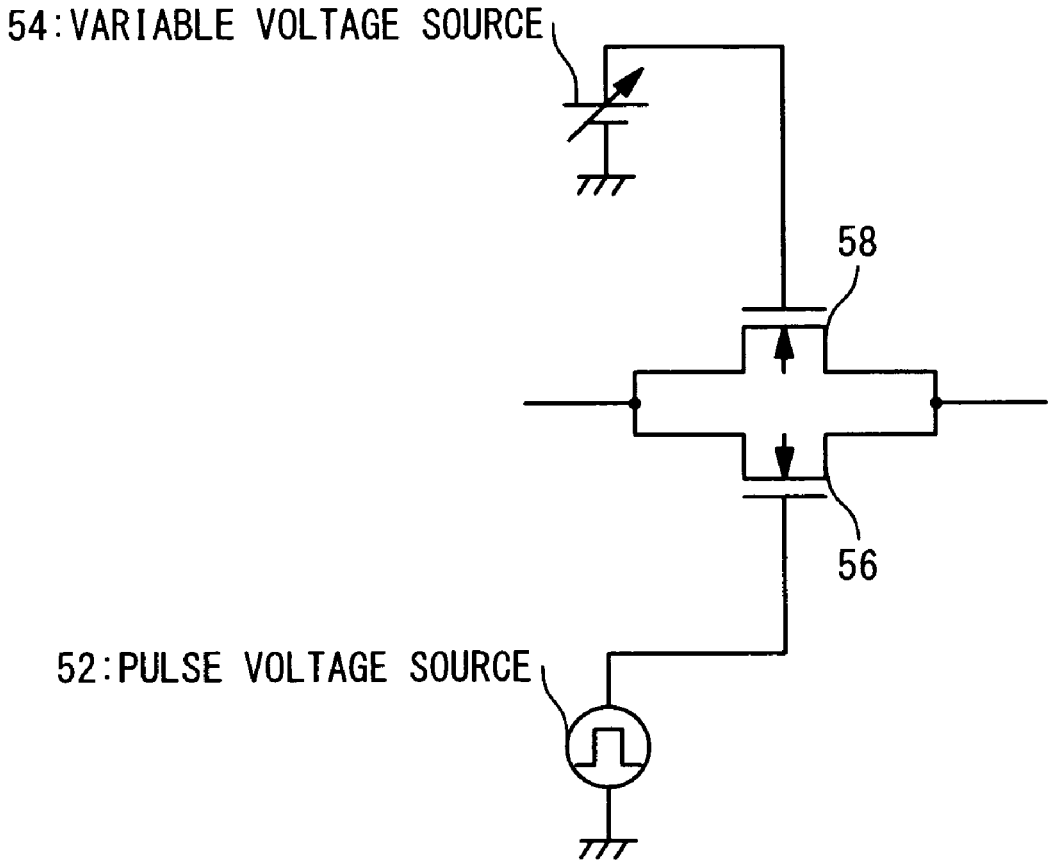
FIG. 10 is a circuit diagram showing a configuration of an output resistive element and a variable resistive element in the output block circuit of the liquid crystal drive circuit according to the third embodiment of the present invention.

FIG. 10 is a circuit diagram showing a configuration example of an output resistive element and a variable resistive element in each amplifier block of the output block circuit 16 of the data line drive circuit 10 in the third embodiment of the present invention. This example is common among the amplifier blocks A to C. The output resistive element 40 (40A, 40B, and 40C) is realized with a MOS transistor 56 and a pulse voltage source 52. Strictly speaking, a switch 44 and the output resistive element 40 are realized with the MOS transistor 56 and the pulse voltage source 52. The control signals a1, b1, and c1 from the timing control circuit 22 act as outputs of the pulse voltage sources 52. The variable resistive element 42 (42A, 42B, 42C) is realized with a MOS transistor 58 and a variable voltage source 54. Strictly speaking, the switch 44 and the variable resistive element 42 are realized with the MOS transistor 58 and the variable voltage source 54. The control signals a2, b2, and c2 from the timing control circuit 22 act as outputs of the variable voltage source 54. In this configuration, each of the MOS transistors 56 and 58 is formed with a transistor of the same size, i.e., having a same gate length and a same gate width. Since the MOS transistors 56 and 58 are connected in parallel, they do not consume a chip area so much and can be constructed simply.

By using such MOS transistors as resistive elements, the resistance values of the switch portions 38A to 38C of the amplifier blocks A to C become OUTA to OUTC, respectively.

Figure 11:
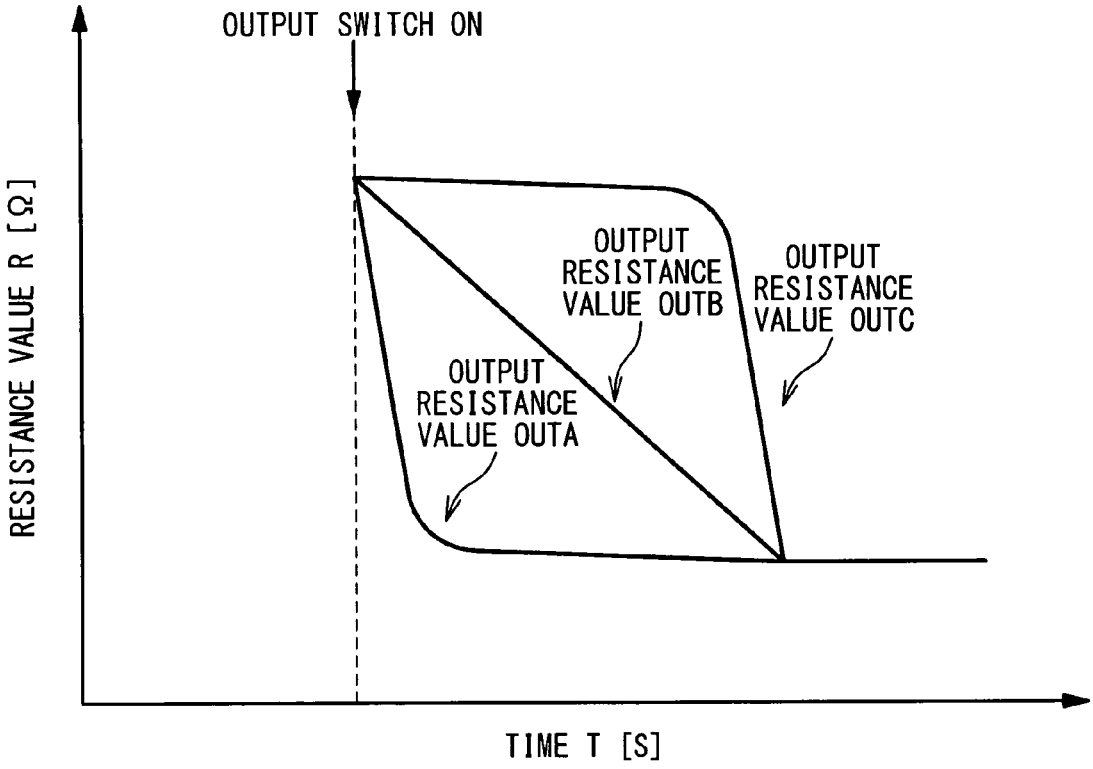
FIG. 11 is a graph showing time dependence of an output resistance value in the output block circuit of the liquid crystal drive circuit according to the third embodiment of the present invention.

FIG. 11 is a graph showing a first example that uses the above-mentioned MOS transistors as resistive elements. Referring to FIG. 11, the amplifier block A is turned on when the control signals a1 and a2 are both high voltages. By this turn-on, the output resistance value OUTA of the amplifier block A will become in a state of a lower resistance value. Moreover, the amplifier block B is turned on with a high voltage of the control signal b1. The control signal b2 changes to a high voltage gradually with time. By this change, the output resistance value OUTB of the amplifier block B will change to a low resistance value so as to be in proportion to a lapse of time. Still moreover, the amplifier block C is turned on with a high voltage of the control signal c1. Even moreover, the control signal c2 changes to a high voltage after a predetermined time. By this change, the output resistance value OUTC of the amplifier block C will change to a low resistance value when a predetermined time lapses. In this example, since the output resistance value of the amplifier block B is decreasing proportionally, currents that flow by ways of the three amplifier blocks A to C will be averaged. In this way, the EMI noise can be reduced.

Figure 12:
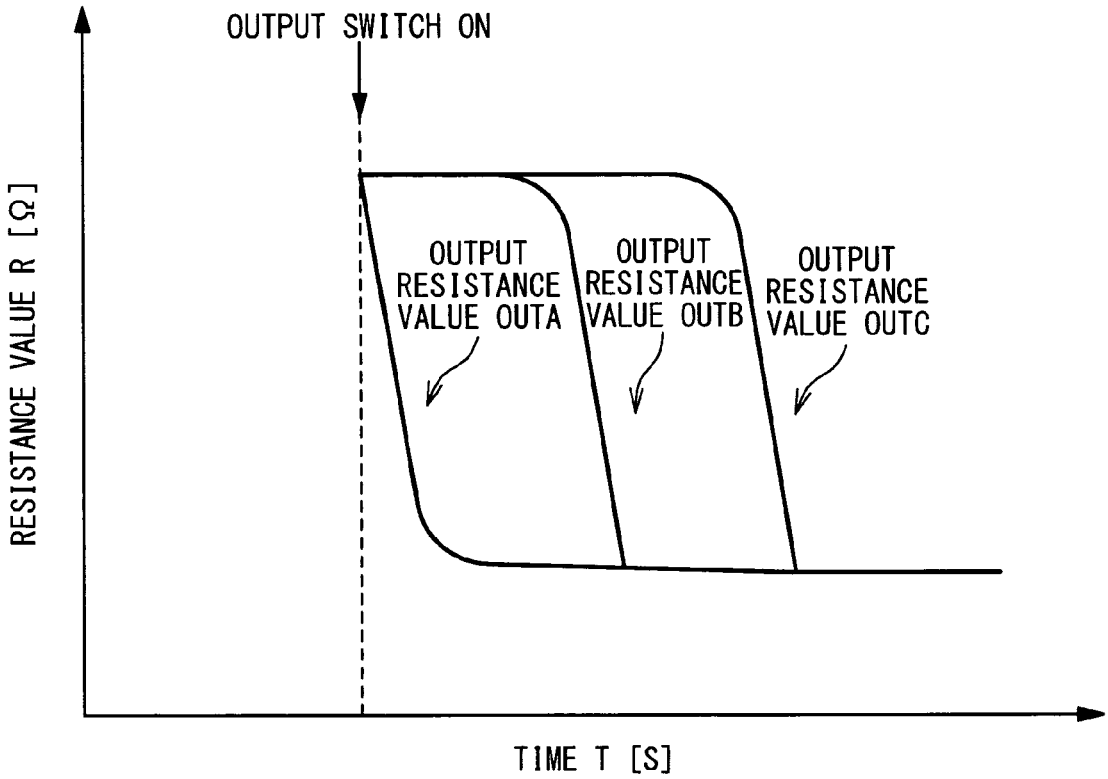
FIG. 12 is a graph showing another time dependence of an output resistance value in the output block circuit of the liquid crystal drive circuit according to the third embodiment of the present invention.

FIG. 12 is a graph showing a second example where the MOS transistors shown in FIG. 10 are used as resistive elements. Referring to FIG. 12, the amplifier block A is turned on when the control signals a1 and a2 are both high voltages. By this turn-on, the output resistance value OUTA of the amplifier block A will be in a state of a lower resistance value. Moreover, the amplifier block B is turned on with a high voltage of the control signal b1. After a lapse of a predetermined time, it is turned on with a high voltage of the control signal b2. By this turn-on, the output resistance value OUTB of the amplifier block B will change to a low-resistance value after a lapse of the predetermined time. Furthermore, the amplifier block C is turned on with a high voltage of the control signal c1. Moreover, after a predetermined time from turning on of the control signal b2, the control signal c2 changes to a high voltage. By this turn-on, the output resistance value OUTC of the amplifier block C will change to a low resistance value when a predetermined time lapses. In this example, since the output resistance value of the amplifier block B decreases abruptly after a predetermined time, the currents that flow in the three amplifier blocks A to C will have three peaks. However, the MOS transistors as resistive elements can reduce a peak charging current compared with the typical (conventional) example. In this way, the EMI noise can be reduced.

As mentioned above, the various embodiments of the present invention were explained. Note here that these embodiments can be combined and carried out in a range where they are consistent with one another.

Moreover, in the present invention, the timing control circuit 22 includes a synchronous or asynchronous delay circuit (not shown) and an arithmetic circuit (not shown). The line output signal is delayed, and each control signal is created from the delayed signal and the original line output signal. By this process, the line output signals that control all amplifier blocks are in the "H" level simultaneously. Therefore, it is avoided that a charge collection period becomes short. In this way, although not illustrated, by short-circuiting the adjacent data lines with a switch on at an output side of the amplifier block, charges can fully be collected and a peak current value can be reduced further.

Even if the liquid crystal panel is enlarged and the data line drive circuit has multi-outputs, a peak current value can be reduced while the data lines are driven at a same timing, and an EMI noise can be reduced.

Furthermore, since the driving timing of the data line is not shifted at this time, a period of collection of charges does not become shorter than necessary.

It is apparent that the present invention is not limited to the above embodiment, but may be modified and changed without departing from the scope and spirit of the invention.

What is claimed is:

1. A data line drive circuit comprising:

a plurality of output circuits configured to output voltages corresponding to grayscale voltages with respect to display data;

a plurality of switch portions configured to switch to an ON-state in response to a line output signal and connect said plurality of output circuits and a plurality of data lines, respectively, wherein ON-resistance values of at least part of said plurality of switch portions vary in said ON-state, wherein each of said plurality of switch portions includes:

a switch, and a parallel circuit configured to be connected to said switch in series, wherein said parallel circuit includes:

a fixed value resistive element, and a variable resistive element configured to be connected to said fixed value resistive element in parallel.

2. A liquid crystal display device comprising:

a display panel configured to includes a plurality of data lines; and a data line drive circuit configured to drive said plurality of data lines, wherein said data line drive circuit includes:

a plurality of output circuits configured to output voltages corresponding to grayscale voltages with respect to display data, and a plurality of switch portions configured to become a ON-state in response to a line output signal and connect said plurality of output circuits and said plurality of data lines, respectively, wherein ON-resistance values of at least part of said plurality of switch portions vary in said ON-state, wherein each of said plurality of switch portions includes:

a switch, and a parallel circuit configured to be connected to said switch in series, wherein said parallel circuit includes:

a fixed value resistive element, and a variable resistive element configured to be connected to said fixed value resistive element in parallel.

* * * * *